US008794706B2

(12) United States Patent
Lin

(10) Patent No.: US 8,794,706 B2
(45) Date of Patent: Aug. 5, 2014

(54) LEG REST ASSEMBLY FOR A CHAIR

(76) Inventor: Chang Chen Lin, Tainan County (TW)

( * ) Notice: Subject to any disclaimer, the term of this patent is extended or adjusted under 35 U.S.C. 154(b) by 294 days.

(21) Appl. No.: 13/527,587

(22) Filed: Jun. 20, 2012

(65) Prior Publication Data

US 2013/0341989 A1 Dec. 26, 2013

(51) Int. Cl.
*A47C 7/50* (2006.01)

(52) U.S. Cl.
USPC ..... 297/423.28; 297/69; 297/85 L; 297/423.3

(58) Field of Classification Search
USPC ..... 297/423.28, 423.3, 423.25, 69, 85 L, 297/85 R, 89
See application file for complete search history.

(56) References Cited

U.S. PATENT DOCUMENTS

| | | | | |
|---|---|---|---|---|
| 3,012,816 | A * | 12/1961 | Lorenz et al. | 297/85 R |
| 5,695,239 | A * | 12/1997 | Johnson et al. | 297/69 |
| 2007/0241589 | A1 * | 10/2007 | LaPointe | 297/85 |
| 2009/0243368 | A1 * | 10/2009 | LaPointe | 297/85 R |
| 2012/0112517 | A1 * | 5/2012 | Hoffman et al. | 297/85 L |
| 2012/0112518 | A1 * | 5/2012 | Murphy et al. | 297/85 L |

* cited by examiner

*Primary Examiner* — David E Allred

(57) ABSTRACT

A leg rest assembly includes two connecting boards fixed to an underside of a seat of a chair. An actuation rod unit and a link unit are mounted to each connecting board. A rear end of each link unit is pivotably connected to one of the connecting boards and one of the actuation rod units. Each link unit has a slot aligned with a guiding groove of one of the connecting boards. A guiding rod extends through the slot of each link unit, the guiding groove of each connecting board, and each actuation rod unit. A mounting plate is pivotably connected to a front end of each link unit. An operative rod is operable to cause movement of the actuation rod units and to move the mounting plate between a first position in front of the base and a second position received in a compartment between the connecting boards.

8 Claims, 7 Drawing Sheets

LEG REST ASSEMBLY FOR A CHAIR

BACKGROUND OF THE INVENTION

The present invention relates to a leg rest assembly for a chair and, more particularly, to a leg rest assembly that can be independently controlled to move between extended positions and a storage position while providing operational stability and enhanced support.

Some conventional chairs include a leg rest to support the shanks of a user sitting on the chair, with the leg rest movable between an extended position and a storage position. A conventional leg rest is generally located below a seat of a chair and extends perpendicularly to the seat. The leg rest can be pivoted to an extended position parallel to the seat. Examples of such a leg rest are disclosed in U.S. Pat. Nos. 6,402,232; 6,572,185; and 7,134,713. However, the extended length of such a leg rest is limited by the height of the seat from the ground.

A leg rest of another type is connected to the backrest and is extended while a user lies against the backrest and causes rearward movement of the backrest. However, the leg rest can not be moved to the extended position without moving the backrest rearward.

BRIEF SUMMARY OF THE INVENTION

An objective of the present invention is to provide a leg rest assembly that can be independently controlled to move between an extended position and an operative position while providing reliable positioning and enhanced support.

Another objective of the present invention is to provide a leg rest assembly having a spring to enhance the operational convenience.

A further objective of the present invention is to provide a leg rest assembly that includes a plurality of extended positions.

A leg rest assembly for a chair according to the present invention includes a base adapted to be fixed below a seat of a chair. The base includes two connecting boards. Each connecting board is adapted to be fixed to an underside of the seat, with the connecting boards being parallel to each other, and with a compartment defined between the connecting boards. Each connecting board includes a guiding groove and a pivotal section. Two actuation rod units are received in the compartment and mounted to the connecting boards, respectively. The actuation rod units are operably connected to an operative rod. Two link units are respectively mounted to the connecting boards. Each link unit has a front end and a rear end. The link units are movable between an extended position and a storage position. The rear end of each link unit is pivotably connected to the pivotal section of one of the connecting boards and pivotably connected to one of the actuation rod units. Each link unit has a slot aligned with the guiding groove of one of the connecting boards. A guiding rod extends through the slot of each link unit, the guiding groove of each connecting board, and each actuation rod unit. A mounting plate is pivotably connected to the front end of each link unit.

The operative rod is operable to cause movement of the two actuation rod units and to move the mounting plate between a first position in front of the base and a second position received in the compartment, with the guiding rod moving along the guiding grooves of the base, with the first position of the mounting plate corresponding to the extended position, with the second position of the mounting plate corresponding to the storage position.

Preferably, the base includes two connecting frames each having an upper connecting portion and one of the connecting boards. The upper connecting portions of the connecting frames are adapted to be fixed two sides of the underside of the seat of the chair. Each connecting board includes a rear end having a through-hole. Each connecting board further includes a peg located between the guiding groove and the through-hole, with an axis extending through a center of the peg and a center of the through-hole. The pivotal section of each connecting board includes first and second pivotal portions, with the first pivotal portion located between the second pivotal portion and the through-hole. The operative rod includes a handle and a connecting rod. The handle is located outside of the connecting boards. The connecting rod is fixed to the handle and rotatably extends through the through-holes of the connecting boars. An auxiliary mechanism is provided on the operative rod and includes a spring and an arm. The arm includes an end fixed to the connecting rod. The spring includes a first end attached to the peg of one of the connecting boards and a second end attached to the other end of the arm. The other end of the arm is located between the first and second ends of the spring. The spring is movable between an upper position above the axis and a lower position below the axis by moving the operative rod and through transmission of the arm and the connecting rod.

Preferably, each actuation rod unit includes a first rod and a second rod. A first end of the first rod is connected to the connecting rod. A first end of the second rod is pivotably connected to a second end of the first rod. Each link unit includes a rear, lower link, a rear, upper link, a front, lower link, and a front, upper link. The rear, lower link includes an intermediate portion between first and second ends thereof and a slot located adjacent to the first end thereof. The first end of the rear, lower link is pivotably connected to the first pivotal portion of one of the connecting boards, with the slot aligned with the guiding groove of the connecting board. A first end of the rear, upper link is pivotably connected to the second pivotal portion of one of the connecting boards. A first end of the front, lower link is pivotably connected to a second end of the rear, lower link. A first end of the front, upper link is pivotably connected to an intermediate portion of the rear, lower link. An intermediate portion of the front, upper link is pivotably connected to a second end of the rear, upper link.

Preferably, the guiding rod extends through the slots of the rear, lower links, the guiding slots of the connecting boards, and the second ends of the second rods of the actuation rod units. The guiding rod is slideable along the guiding grooves of the connecting boards. A bearing is mounted to each of two ends of the guiding rod and is received in the guiding groove of one of the connecting boards.

Preferably, a front end of each guiding groove includes a first extension positioning portion, and a rear end of each guiding groove includes a storage positioning portion. The guiding rod is releasably engaged in one of the first extension positioning portion and the storage positioning portion of each guiding groove.

Preferably, each guiding groove further includes a second extension positioning portion located between the first extension positioning portion and the storage positioning portion.

Preferably, each of the first and second extension positioning portions and the storage positioning portion of each guiding groove includes a positioning groove having an upper opening.

The present invention will become clearer in light of the following detailed description of illustrative embodiments of this invention described in connection with the drawings.

DETAILED DESCRIPTION OF THE INVENTION

Figure 1:
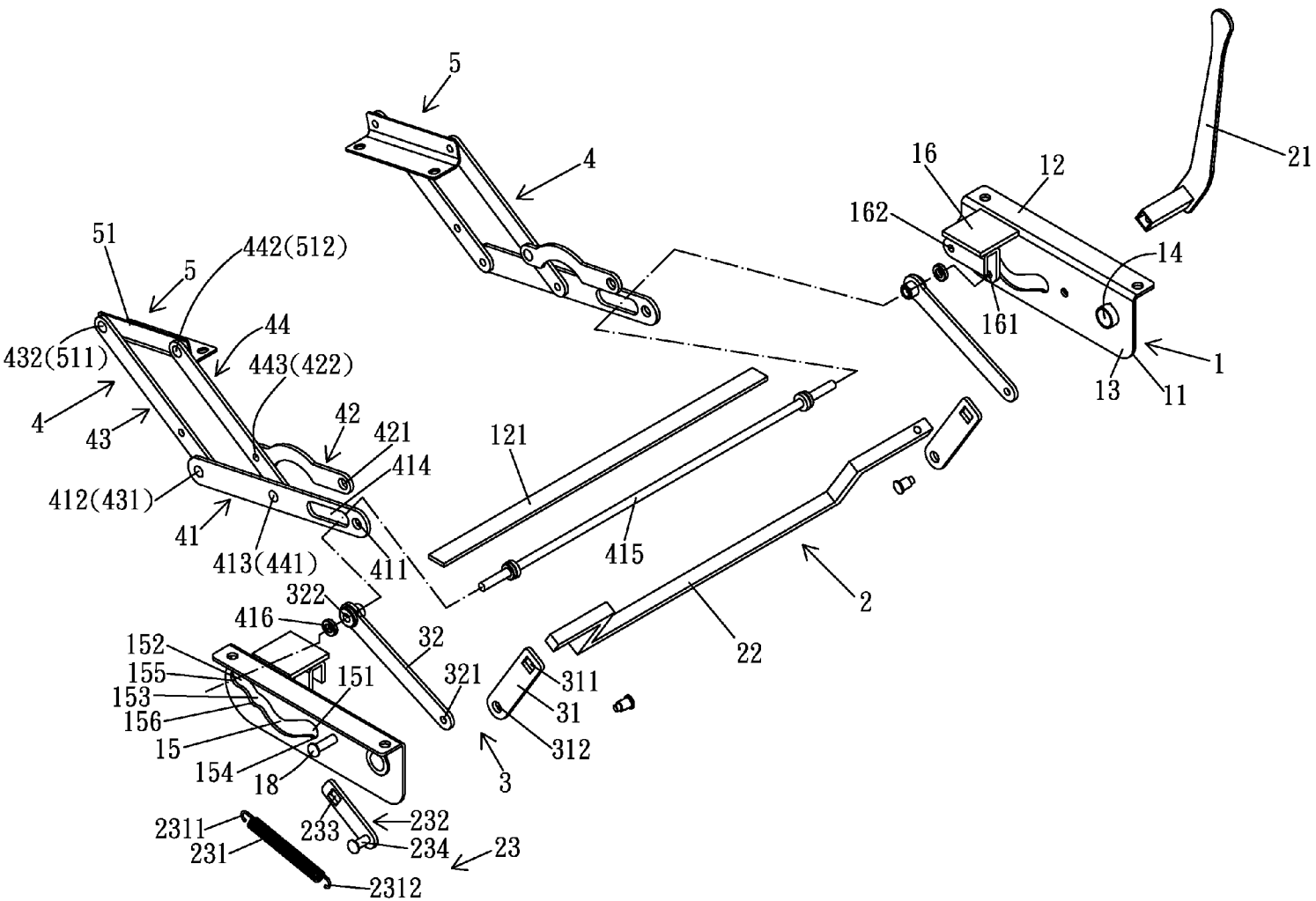
FIG. 1 shows an exploded, perspective view of a leg rest assembly according to the present invention.

With reference to FIGS. 1-4, a leg rest assembly according to the present invention includes a base 1, an operative rod 2, two actuation rod units 3, two link units 4, and a mounting plate 5. The base 1 includes two connecting frames 11, with each connecting frame 11 being substantially L-shaped in cross section and including an upper connecting portion 12 and a connecting board 13 below the upper connecting portion 12. The upper connecting portions 12 of the connecting frames 11 are interconnected by a fixing board 121 and are fixed by fasteners to two sides of an underside of the seat 6 of the chair, with the connecting boards 13 perpendicular to the underside of the chair 6, with the connecting boards 13 parallel to each other, and with a compartment 17 defined between the connecting boards 13. Each connecting board 13 includes a through-hole 14 in a rear end thereof and a guiding groove 15 in a front end thereof. The guiding groove 15 is arcuate in the form shown and includes a storage positioning portion 151 in the rear end thereof and first and second extension positioning portions 152 and 153 in the front end thereof, with the second extension positioning portion 153 located between the first extension positioning portion 152 and the storage positioning portion 151. Each of the storage positioning portion 151 and the first and second extension positioning portions 152 and 153 includes a positioning groove 154, 155, 156 having an upper opening. Each connecting board 13 further includes a pivotal section 16. In the form shown, the pivotal section 16 includes first and second pivotal portions 161 and 162 located above the guiding groove 15, with the first pivotal portion 161 located between the second pivotal portion 162 and the through-hole 14. Each connecting board 13 further includes a peg 18 between the guiding groove 15 and the through-hole 14, with an axis X extending through a center of the peg 18 and a center of the through-hole 14 (see FIGS. 3-5 and 7).

The operative rod 2 includes a handle 21 and a connecting rod 22. The handle 21 is located outside of the connecting frames 11. The connecting rod 22 extends through the through-holes 14 of the connecting boards 13. The connecting rod 22 has non-circular cross sections. An end of the handle 21 has cross sections corresponding to the non-circular cross sections of the connecting rod 22. The end of the handle 21 is fixed to an end of the connecting rod 22. Thus, rotation of the handle 21 causes rotation of the connecting rod 22 relative to the connecting boards 13. An auxiliary mechanism 23 is provided on the operative rod 2 and includes a spring 231 and an arm 232. An end 2311 of the spring 231 is attached to the peg 18 of one of the connecting boards 13. The other end 2312 of the spring 231 is attached to the arm 232. Specifically, an end of the arm 232 includes an axle hole 233 that is square in cross section in the form shown, with the connecting rod 22 extending through the axle hole 233 to allow joint movement of the connecting rod 22 and the arm 232. A peg 234 is formed on the other end of the activation rod 232. The other end 2312 of the spring 231 is attached to the peg 234. The axle hole 233 is located between the ends 2311 and 2312 of the spring 231. The arm 232 can be driven by the connecting rod 22 to rotate, moving the spring 231 to a position below or above the axis X.

The actuation rod units 3 are symmetrically mounted in the compartment 17 and respectively mounted to the connecting frames 11. Each actuation rod unit 3 includes a first rod 31 and a second rod 32. A first end 311 of the first rod 31 has a non-circular hole and is connected to the connecting rod 22. The first rod 31 is moved when the connecting rod 22 rotates. A first end 321 of the second rod 32 is pivotably connected to a second end 312 of the first rod 321. The second rod 32 further includes a second end 322.

The link units 4 are symmetrically mounted in the compartment 17 and respectively mounted to the connecting frames 11. Each link unit 4 includes a rear, lower link 41, a rear, upper link 42, a front, lower link 43, and a front, upper link 44. The rear, lower link 41 includes first and second ends 411 and 412 and an intermediate portion 413, with a slot 414 located adjacent to the first end 411 of the rear, lower link 41. The first end 411 of the rear, lower link 41 is pivotably connected to the first pivotal portion 161 of one of the connecting boards 13, with the slot 414 aligned with the guiding groove 15 of the connecting board 13. A guiding rod 415 is extended through the slots 414 of the rear, lower links 41, the guiding slots 15 of the connecting boards 13, and the second ends 322 of the second rods 32 of the actuation rod units 3. The guiding rod 415 can slide along the guiding grooves 15. A bearing 416 is mounted to each of two ends of the guiding rod 415 and received in the guiding groove 15 of one of the connecting boards 13, allowing smooth movement of the guiding rod 415. The rear, upper link 42 includes a first end 421 and a second end 422, with the first end 421 of the rear, upper link 42 pivotably connected to the second pivotal portion 162 of one of the connecting boards 13. The front, lower link 43 includes a first end 431 and a second end 432, with the first end 431 of the front, lower link 43 pivotably connected to the second end 412 of the rear, lower link 41. The front, upper link 44 includes first and second ends 441 and 442 and an intermediate portion 443, with the first end 441 of the front, upper link 44 pivotably connected to the intermediate portion 413 of the rear, lower link 41, with the intermediate portion 443 of the front, upper link 44 pivotably connected to the second end 422 of the rear, upper link 42.

The mounting plate 5 includes two brackets 51 respectively and pivotably connected to the link units 4. Specifically, each bracket 51 includes a first end 511 pivotably connected to the second end 432 of the front, lower link 43 of one of the link units 4 and a second end 512 pivotably connected to the second end 442 of the front, upper link 44 of one of the link units 4. A leg rest can be mounted on the brackets 51.

Figure 2:
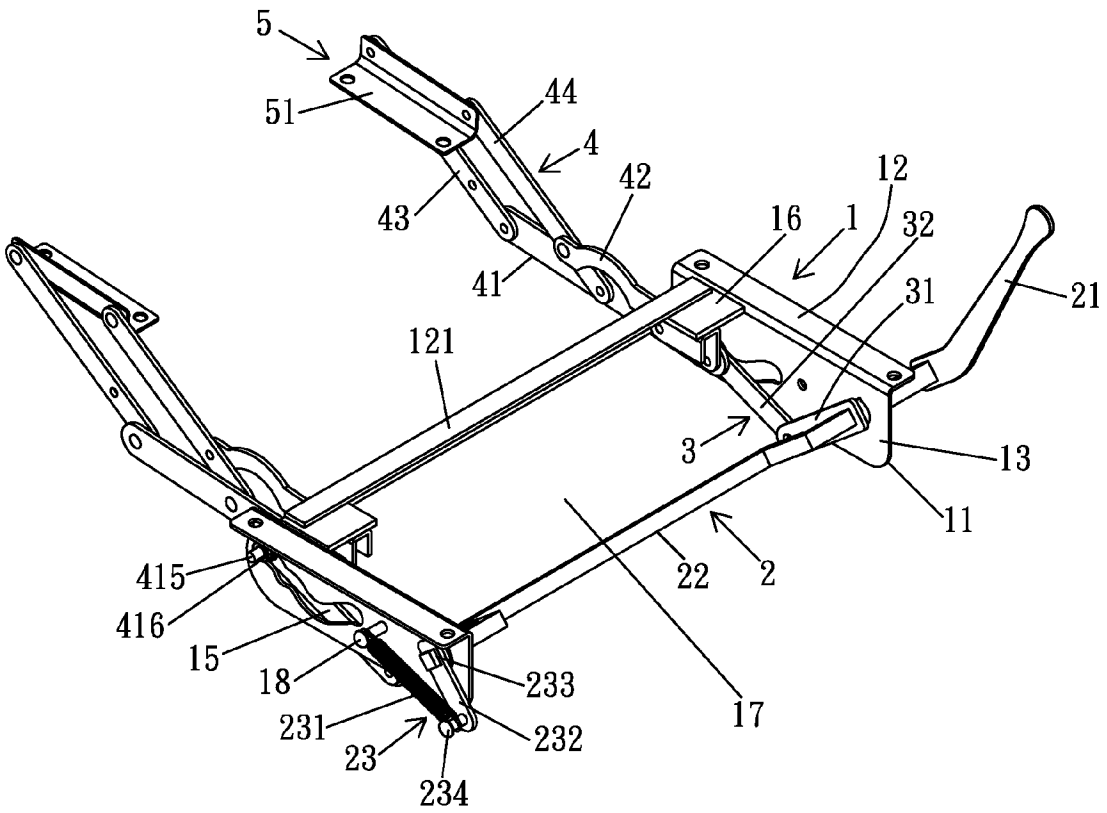
FIG. 2 shows a perspective view of the leg rest assembly of FIG. 1.
Figure 3:
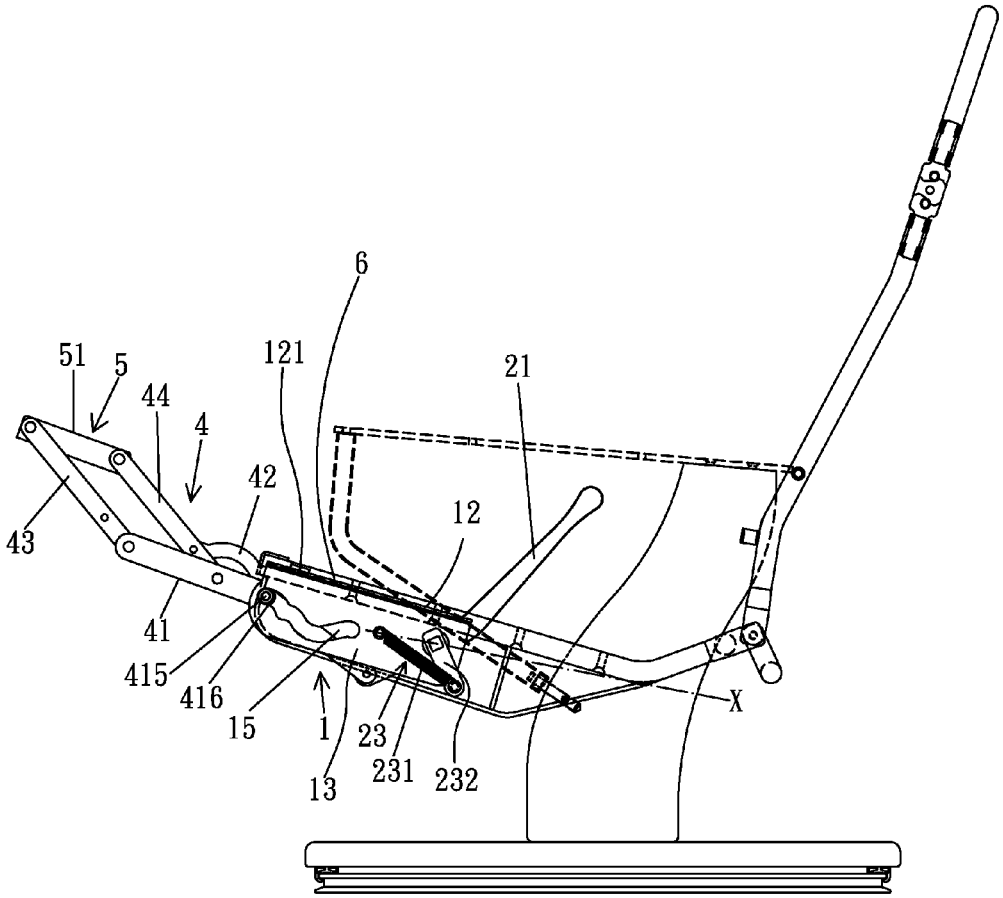
FIG. 3 shows a side view of a chair and the leg rest assembly of FIG. 1.
Figure 4:
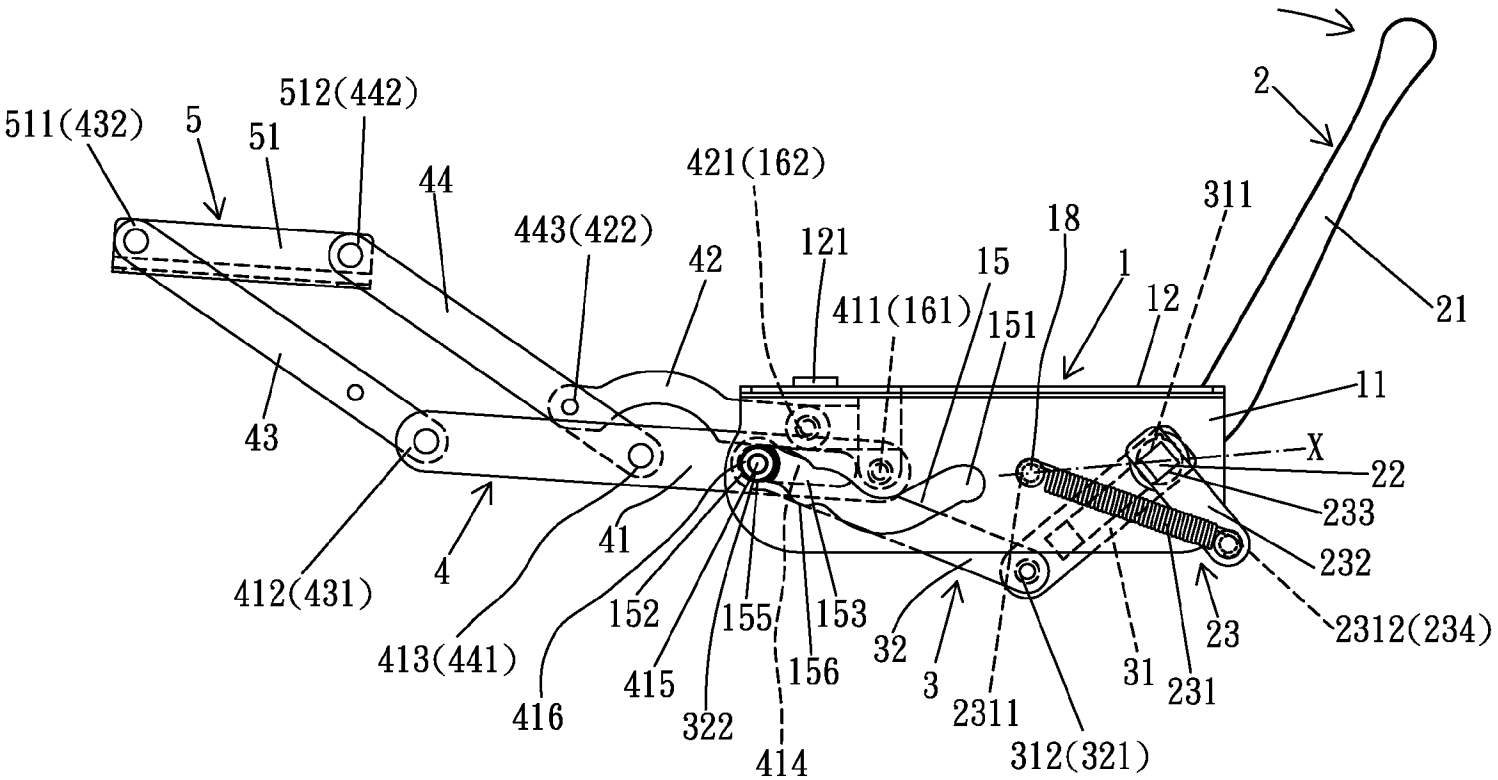
FIG. 4 shows a side view of the leg rest assembly, illustrating movement of the leg rest assembly to an extended position.

With reference to FIGS. 2-4, the handle 21 can be operated to move the operative rod 2, the link units 4, and the bracket 5 to extend out of the compartment 17, with the guiding rod 415 moving along the guiding grooves 15. The guiding rod 415 can be positioned in the first extension positioning portion 152 of each connecting board 13 and engaged in the positioning groove 155 of each connecting board 13, retaining the leg rest assembly in a first extended position. The spring 231 is located below the axis X. Since the positioning groove 155 is a groove having an upper opening, the weight of the legs of a user sitting on the seat 6 of the chair can reliably engage the guiding rod 415 in the first extension positioning portion 152 of each connecting board 13. Furthermore, the two connecting frames 11 evenly support the force imparted to link units 4 and the mounting plate 5, providing enhanced supporting reliability.

Figure 5:
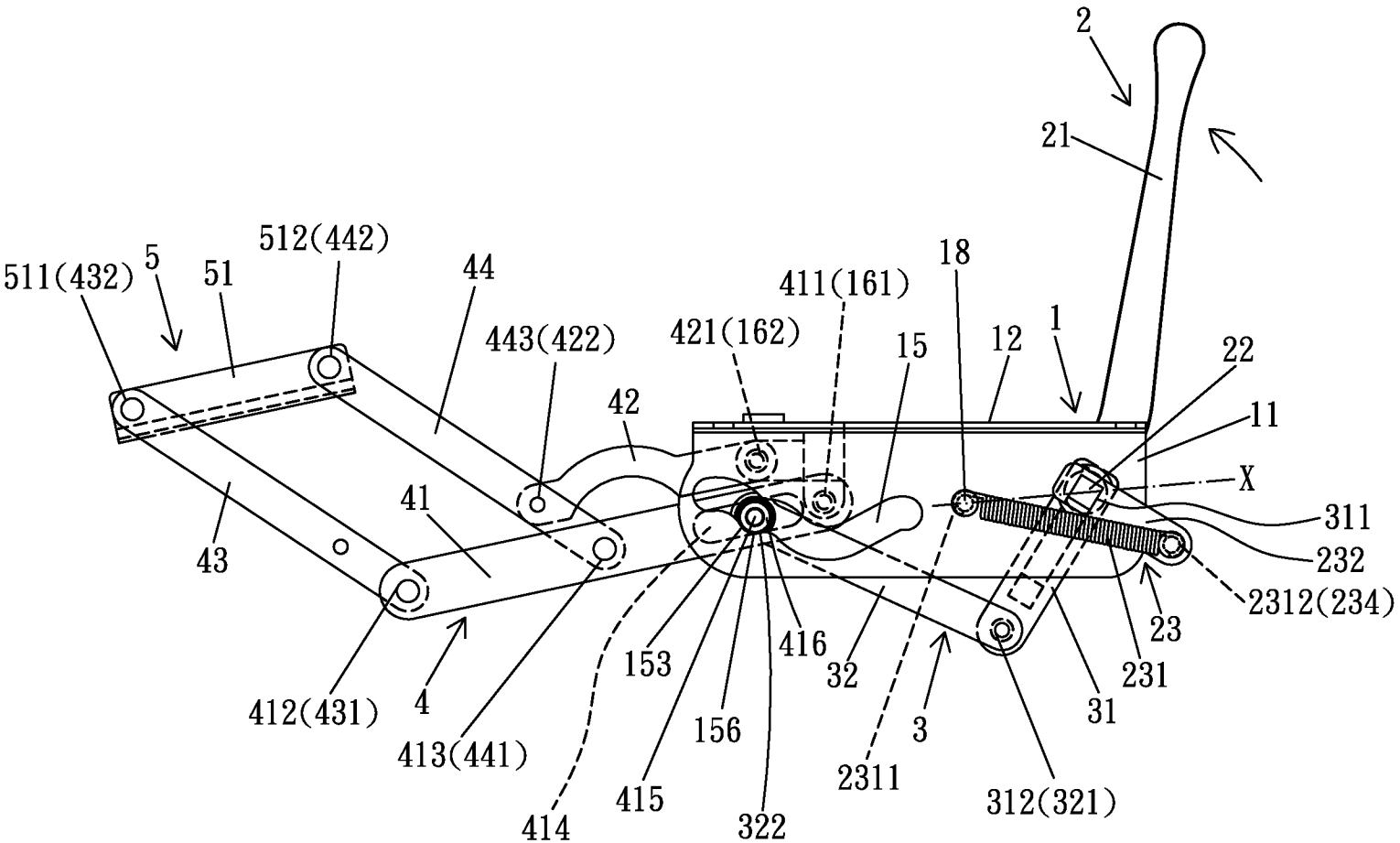
FIG. 5 shows a view similar to FIG. 4, with the leg rest assembly moved to another extended position.

With reference to FIG. 5, the handle 21 can be operated to move the mounting plate 5 rearward. The engage the guiding rod 415 is moved to a position engaged in the positioning grooves 156 of the extension positioning portions 152 of the connecting boards 13. Thus, the leg rest assembly is retained in a second extended position. Thus, the position of the leg rest assembly can be adjusted according to the length of the legs of the user.

Figure 6:
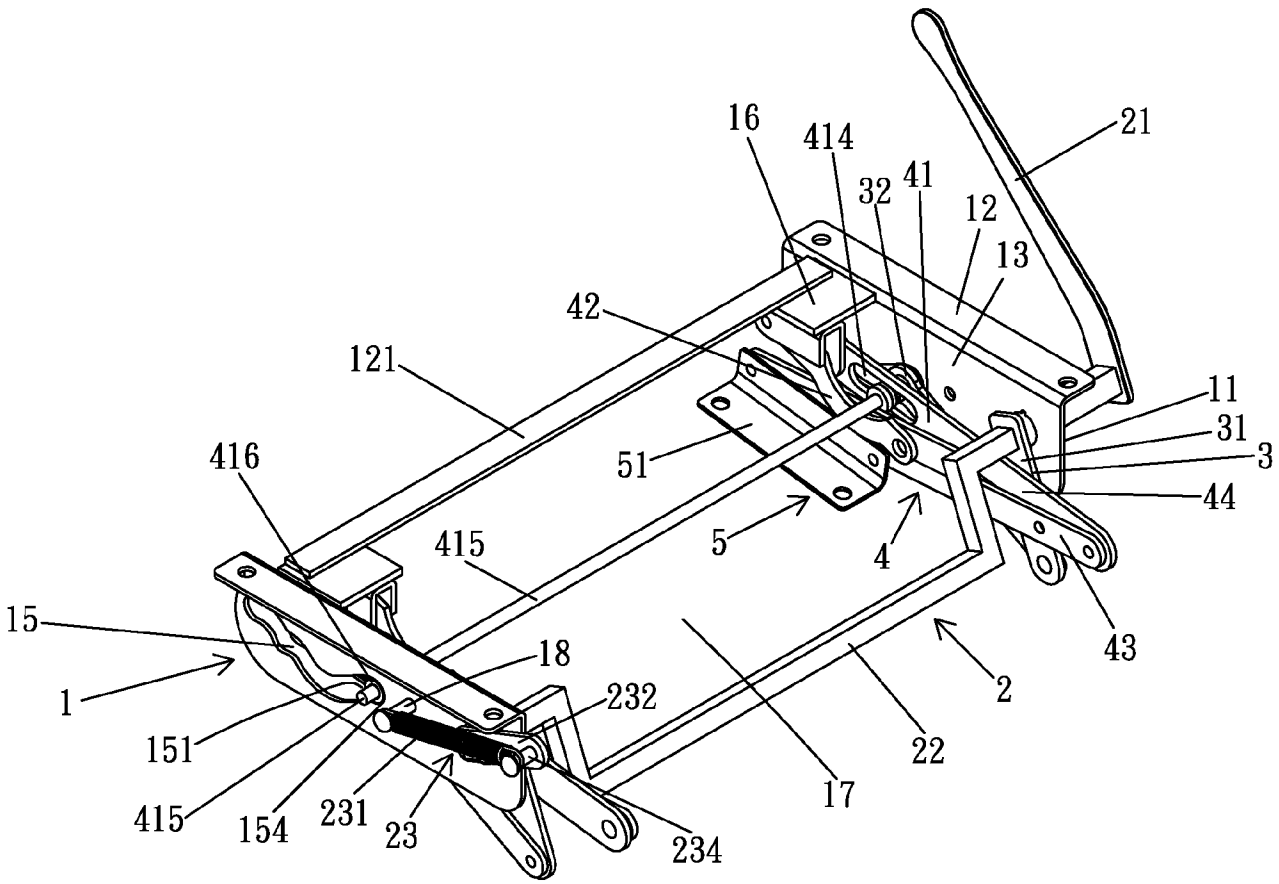
FIG. 6 shows a perspective view of the leg rest assembly of FIG. 1, with the leg rest assembly in a storage position.
Figure 7:
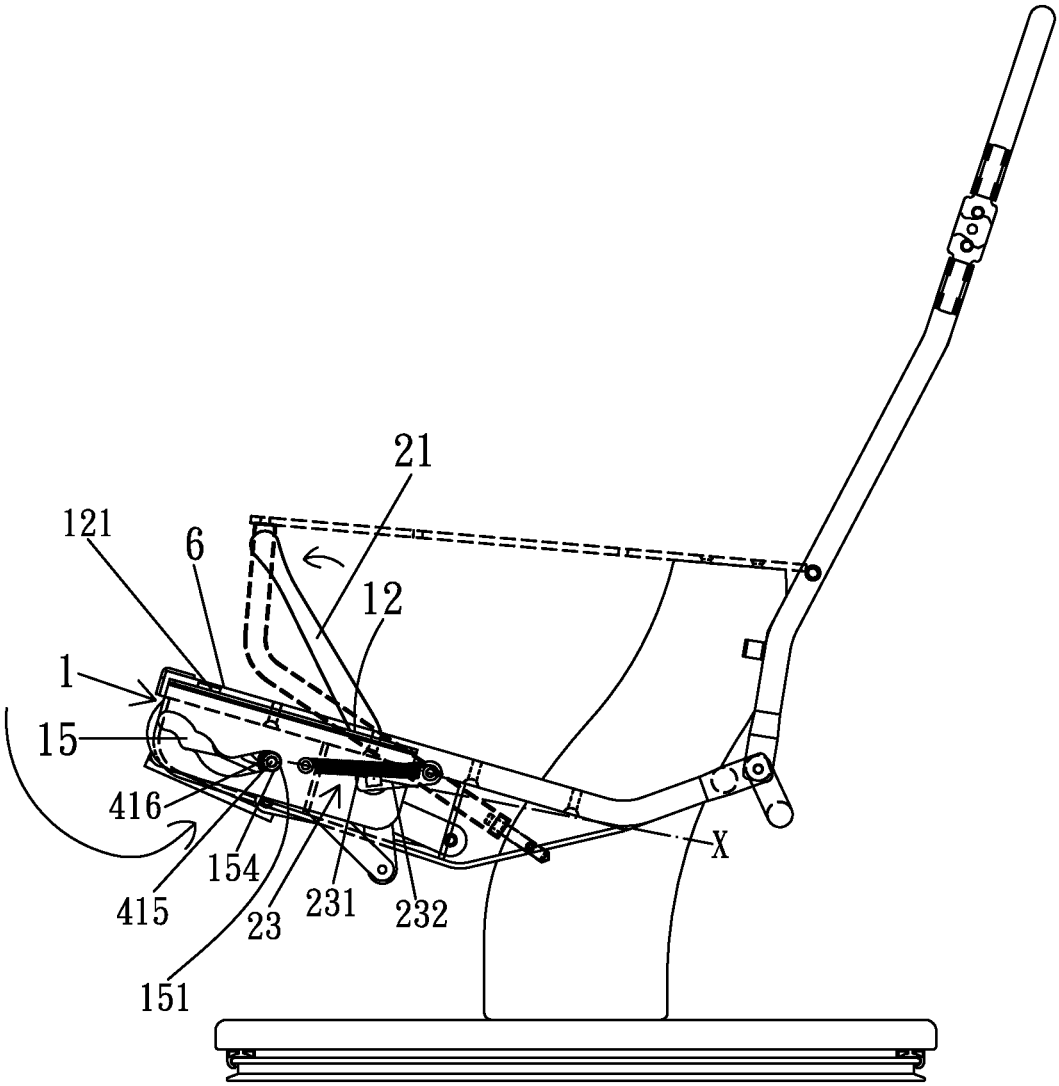
FIG. 7 shows a view similar to FIG. 3, with the leg rest assembly in the storage position.

With reference to FIGS. 6 and 7, the operative rod 21 can be rotated to rotate the connecting rod 22 to cause movement of the first and second rods 31 and 32 of the actuation rod units 3 and to move the link units 4 rearward, moving the mounting plate 5 into the compartment 17. The guiding rod 415 is engaged in the positioning grooves 154 of the storage positioning portions 151 of the guiding grooves 15 of the connecting boards 13. Thus, the leg rest assembly is retained in the storage position. The spring 231 is located above the axis X. The length of the slots 414 allows smooth movement of the guiding rod 415. The shape of the guiding grooves 15 correspond to the path of the guiding rod 415 between the first and second extended positions and the storage position. Note that the spring 231 is stretched when the spring 231 is in alignment with the axis X. When the spring 231 reaches the position above the axis X, the spring 231 provides a returning force to assist in moving the leg rest assembly to the storage position, providing quicker and more convenient operation. On the other hand, when the leg rest assembly is moved from the storage position to the first or second extended position, the spring 231 is stretched when the spring 231 is in alignment with the axis X and then returns to its original shape when the spring 231 reaches the position below the axis X, assisting in moving the leg rest assembly to the first or second extended position.

Thus, the leg rest assembly can be moved between the storage position and the first and second extended positions without actuating the backrest of the chair, providing reliable support without limitation by the height of the seat 6 of the chair.

It can be appreciated that the leg rest assembly can include two guiding rods 415 each extending through the slot 414 of the rear, lower link 41 of one of the link units 4, the guiding slot 15 of one of the connecting boards 13, and the second end 322 of the second rod 32 of one of the actuation rod units 3. The guiding rods 415 can slide along the guiding grooves 15 respectively of the connecting boards 13.

Although specific embodiments have been illustrated and described, numerous modifications and variations are still possible without departing from the essence of the invention. The scope of the invention is limited by the accompanying claims.

The invention claimed is:

1. A leg rest assembly for a chair comprising:

a base adapted to be fixed below a seat of a chair, with the base including two connecting boards, with each of the two connecting boards adapted to be fixed to an underside of the seat, with the two connecting boards being parallel to each other, with a compartment defined between the two connecting boards, with each of the two connecting boards including a guiding groove and a pivotal section;

an operative rod;

two actuation rod units received in the compartment and mounted to the two connecting boards, respectively, with the two actuation rod units operably connected to the operative rod;

two link units respectively mounted to the two connecting boards, with each of the link units having a front end and a rear end, with the two link units movable between an extended position and a storage position, with the rear end of each of the two link units pivotably connected to the pivotal section of one of the two connecting boards and pivotably connected to one of the two actuation rod units, with each of the two link units having a slot aligned with the guiding groove of one of the two connecting boards, with a guiding rod extending through the slot of each of the two link units, the guiding groove of each of the two connecting boards, and each of the two actuation rod units; and a mounting plate pivotably connected to the front end of each of the two link units, wherein the operative rod is operable to cause movement of the two actuation rod units and to move the mounting plate between a first position in front of the base and a second position received in the compartment, with the guiding rod moving along the guiding grooves of the base, with the first position of the mounting plate corresponding to the extended position, with the second position of the mounting plate corresponding to the storage position.

2. The leg rest assembly for a chair as claimed in claim 1, with the base including two connecting frames each having an upper connecting portion and one of the two connecting boards, with the upper connecting portions of the two connecting frames adapted to be fixed two sides of the underside of the seat of the chair, with each of the two connecting boards including a rear end having a through-hole, with each of the two connecting boards further including a peg located between the guiding groove and the through-hole, with an axis extending through a center of the peg and a center of the through-hole, with the pivotal section of each of the two connecting boards including first and second pivotal portions, with the first pivotal portion located between the second pivotal portion and the through-hole, with the operative rod including a handle and a connecting rod, with the handle located outside of the two connecting boards, with the connecting rod fixed to the handle and rotatably extending through the through-holes of the two connecting boards, with an auxiliary mechanism provided on the operative rod and including a spring and an arm, with the arm including an end fixed to the connecting rod, with the spring including a first end attached to the peg of one of the two connecting boards and a second end attached to another end of the arm, with the other end of the arm located between the first and second ends of the spring, with the spring being movable between an upper position above the axis and a lower position below the axis by moving the operative rod and through transmission of the arm and the connecting rod.

3. The leg rest assembly for a chair as claimed in claim 2, with each of the two actuation rod units including a first rod and a second rod, with each of the first and second rods having first and second ends, with the first end of the first rod connected to the connecting rod, with the first end of the second rod pivotably connected to the second end of the first rod, with each of the two link units including a rear, lower link, a rear, upper link, a front, lower link, and a front, upper link, with each of the rear, lower link, the rear, upper link, the front, lower link, and the front, upper link having first and second ends, with the rear, lower link further including an intermediate portion between the first and second ends thereof and the slot located adjacent to the first end thereof, with the front, upper link further including an intermediate portion between the first and second ends thereof, with the first end of the rear, lower link pivotably connected to the first pivotal portion of one of the two connecting boards, with the slot aligned with the guiding groove of the connecting board, with the first end of the rear, upper link pivotably connected to the second pivotal portion of one of the two connecting boards, with the first end of the front, lower link pivotably connected to the second end of the rear, lower link, with the first end of the front, upper link pivotably connected to the intermediate portion of the rear, lower link, with the intermediate portion of the front, upper link pivotably connected to the second end of the rear, upper link.

4. The leg rest assembly for a chair as claimed in claim 3, with the guiding rod extending through the slots of the rear, lower links, the guiding grooves of the two connecting boards, and the second ends of the second rods of the two actuation rod units, with the guiding rod slideable along the guiding grooves of the two connecting boards, with a bearing mounted to each of two ends of the guiding rod and received in the guiding groove of one of the two connecting boards.

5. The leg rest assembly for a chair as claimed in claim 2, with the guiding groove of each of the two connecting boards including a front end and a rear end, with the front end of each of the guiding grooves including a first extension positioning portion, with the rear end of each of the guiding grooves including a storage positioning portion, with the guiding rod releasably engaged in one of the first extension positioning portion and the storage positioning portion of each of the guiding grooves.

6. The leg rest assembly for a chair as claimed in claim 5, with each of the guiding groove further including a second extension positioning portion located between the first extension positioning portion and the storage positioning portion.

7. The leg rest assembly for a chair as claimed in claim 6, with each of the first and second extension positioning portions and the storage positioning portion of each of the guiding grooves including a positioning groove having an upper opening.

8. The leg rest assembly for a chair as claimed in claim 5, with the guiding rod extending through the slots of the rear, lower links, the guiding grooves of the two connecting boards, and the second ends of the second rods of the two actuation rod units, with the guiding rod slideable along the guiding grooves of the two connecting boards, with a bearing mounted to each of two ends of the guiding rod and received in the guiding groove of one of the two connecting boards.

* * * * *